US005303011A

United States Patent [19]

Noguchi et al.

[11] Patent Number: 5,303,011

[45] Date of Patent: Apr. 12, 1994

[54] IMAGE FORMING APPARATUS

[75] Inventors: Yukio Noguchi; Masanori Nagayama, both of Yokohama, Japan

[73] Assignee: Ricoh Company, Ltd., Tokyo, Japan

[21] Appl. No.: 880,557

[22] Filed: May 8, 1992

[30] Foreign Application Priority Data

May 10, 1991 [JP] Japan ..... 3-105623

[51] Int. Cl.[5] ..... G03G 21/00

[52] U.S. Cl. ..... 355/246; 355/203; 355/205; 355/208; 355/296

[58] Field of Search ..... 355/246, 208, 203, 204, 355/215, 205, 296, 298; 222/DIG. 1; 118/688-690, 652

[56] References Cited

U.S. PATENT DOCUMENTS 4,032,227 6/1977 Hubbard et al. ..... 118/690 X
4,777,512 10/1988 Takahashi et al. ..... 355/208
4,786,942 11/1988 Kusumoto et al. ..... 355/246 X
4,955,317 9/1990 Kinoshita et al. ..... 118/689

*Primary Examiner*—Matthew S. Smith
*Attorney, Agent, or Firm*—Oblon, Spivak, McClelland, Maier & Neustadt

[57] ABSTRACT

An image forming apparatus. In a copy control mode, a main motor, an eraser, a cleaning bias power source, a cleaning motor, a developing bias power source, a discharge lamp, and a pretransfer discharger are turned on. Then, a precleaning discharger and a main charger are turned on. After such units have been stabilized, a developing motor is energized. Even when a developing unit is operated while an image forming operation is not under way, a toner and a carrier forming a magnet brush on a developing roller included in the developing unit are prevented from depositing on a photoconductive element and, therefore, from being scattered around, damaging the photoconductive element or contaminating the background. Further, the carrier is prevented from causing a spark to occur in a corona discharger and burning the discharger by entering it.

6 Claims, 18 Drawing Sheets

START
STEP 14
TO START COPY ?
N
Y
COPY CONTROL ON
CALL 100
STEP 15
SAMPLE CONCENTRATION DATA Dx
STEP 16
STEP 17
Dx < Do ?
N
Y
STEP 18
STEP 19
COUPLE CLUTCH
UNCOUPLE CLUTCH
STEP 20
TO END COPY ?
N
Y
CALL 200
COPY CONTROL OFF
STEP 21
OUT

START
TO START COPY ?
STEP 22
N
Y
COPY CONTROL ON
CALL 100
STEP 23
STEP 24
CLUTCH 62 COUPLED ?
N
Y
STEP 25
COUNT TONER SUPPLY TIME Tx
STEP 26
CLUTCH 62 COUPLED ?
N
Y
STEP 27
Tx ≧ To ?
N
Y
STEP 28
END COUNTING TIME Tx & CLEAR IT TO 0
STEP 34
CLEAR TONER SUPPLY TIME Tx & Cx TO 0
STEP 35
TO END COPY ?
N
Y
CALL 200
COPY CONTROL OFF
STEP 36
3
4
5
6

IMAGE FORMING APPARATUS

BACKGROUND OF THE INVENTION

The present invention relates to a copier, facsimile transceiver, printer or similar electrophotographic image forming apparatus having a developing device which develops a latent image electrostatically formed on an image carrier by a two-component developer made up of a toner and a carrier.

In an image forming apparatus of the type described, e.g., a copier usually causes a two-component developer to form a magnet brush on a developing roller included in a developing device. The magnet brush is brought into contact with an electrostatic latent image formed on an image carrier, or photoconductive element, to thereby develop the latent image. It is a common practice with this type of apparatus to sense the toner concentration of the developer for the purpose of maintaining it adequately. When the toner concentration is lower than a predetermined threshold, a fresh toner is supplied from a toner hopper to the developer. When the toner hopper runs out of toner as determined by the sensor, it is determined that a so-called toner end condition is reached, and the copier is inhibited from operating. Then, a fresh toner is supplied to the toner hopper and, after a toner end recovery mode operation, the copier is restored to a ready state. Specifically, in the toner end condition, the toner concentration of the developer is lower than the threshold. In this condition, the toner end recovery mode operation is executed such that the developing device supplies the toner from the toner hopper to the developer to provide it with an adequate toner concentration and, at the same time, an agitator disposed in the device is rotated to sufficiently charge the developer. This allows the developing device to perform an adequate developing operation after the restart of the copier.

This type of conventional copier has various problems left unsolved, as follows. Assume that the copier is brought to a stop due to a paper jam or similar cause before a cleaning device removes the toner remaining on the photoconductive element or before a discharger dissipates a charge also remaining thereon. If the copier is restarted with the toner remaining on the photoconductive element, the toner is apt to smear, for example, a paper sheet or similar recording medium to thereby degrade image quality. On the other hand, the charge remaining on the photoconductive element renders the surface potential of the element unstable and, therefore, causes the toner and carrier forming a magnet brush on the developing sleeve to adhere to the element on the restart of the copier. The toner so deposited on the photoconductive element will be released from the element by the subsequent operation, smearing various units disposed in the copier. The carrier deposited on the photoconductive element is apt to damage the element and, therefore, to contaminate the background of a reproduction and/or to render the image density irregular. Further, when the photoconductive element is driven with the carrier deposited thereon, the carrier enters a transfer charger and other corona discharges to cause a spark to occur. In addition, it is likely that the carrier adheres to the end blocks of a corona discharger supporting a wire, burning the wire to therby reduce the life of the discharger.

Moreover, even during the toner concentration adjustment or in the toner end recovery mode, the developing roller is caused to rotate while the photoconductive element is held in a halt. This also gives rise to the problems discussed above in relation to the restart of the copier after a paper jam. It should be noted that when the developing roller is rotated while the photoconductive element is in a halt, the toner forming the magnet brush on the developing roller is transferred to the photoconductive element even if the potential of the element is substantially 0 V, smearing the background of a reproduction.

SUMMARY OF THE INVENTION

It is therefore an object of the present invention to provide an image forming apparatus which prevents, even when a developing device is operated while an image forming operation is not under way, a toner and a carrier forming a magnet brush on a developing roller from depositing on a photoconductive element.

In accordance with the present invention, an image forming apparatus comprises an image carrier for electrostatically forming a latent image thereon, a charger for uniformly charging the surface of the image carrier, an exposing device for exposing the charged surface of the image carrier by imagewise light to form the latent image, a developing device comprising a developer carrier located to face the image carrier and carrying a two-component developer made up of a toner and a carrier thereon for developing the latent image by supplying the toner to the latent image, a toner concentration adjusting device for performing a toner concentration adjusting operation including drive of the developer carrier for controlling the toner concentration of the developer to a predetermined value, a cleaning device for removing the toner remaining on the image carrier after a developing operation, a discharger for dissipating a charge from the image carrier, and a controller for activating at least the image carrier, cleaning device and discharger in synchronism with the toner concentration adjusting operation of the toner concentration adjusting device.

Also, in accordance with the present invention, an image forming apparatus comprises an image carrier for electrostatically forming a latent image thereon, a charger for uniformly charging the surface of the image carrier, an exposing device for exposing the charged surface of the image carrier by imagewise light to form the latent image, a developing device comprising a developer carrier located to face the image carrier and carrying a two-component developer made up of a toner and a carrier thereon for developing the latent image by supplying the toner to the latent image, a toner storing portion for storing a toner to be supplied to the developer, a toner end recovery device for performing, after the toner in the toner storing portion has decreased to below a predetermined amount and then a fresh toner has been supplied to the toner storing portion, a toner end recovery operation including drive of the image carrier for allowing the developing device to perform an adequate developing operation, a cleaning device for removing the toner remaining on the image carrier after a developing operation, a discharger for dissipating a charge from the image carrier, and a controller for activating at least the image carrier, cleaning device and discharger in synchronism with the toner end recovery operation of the toner end recovery device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

An image forming apparatus in accordance with the present invention will be described hereinafter.

Figure 8:
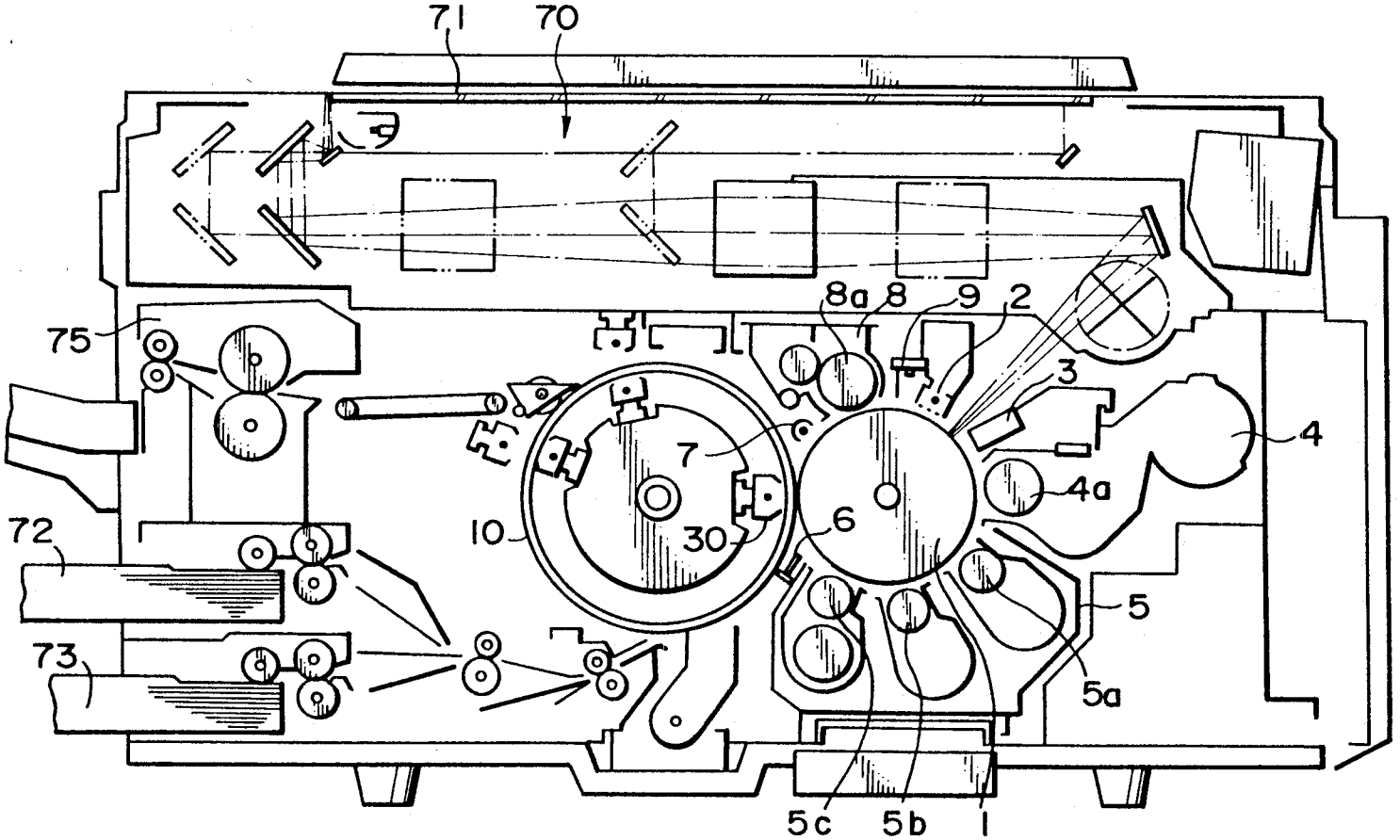
FIG. 8 is a section showing the construction of a color copier of the present invention.

Referring to FIG. 8 an image forming apparatus implemented as a color copier is shown and includes a photoconductive element in the form of a drum 1. The drum 1 is rotatable clockwise as viewed in the figure. Arranged around the drum 1 are a main charger 2, an eraser 3, a black developing unit 4, a color developing unit 5, a pretransfer discharger 6, a precleaning discharger 7, a cleaning unit 8, and a discharge lamp 9. A transfer drum 10 is located to face the photoconductive drum 1 and rotatable counterclockwise.

Figure 9:
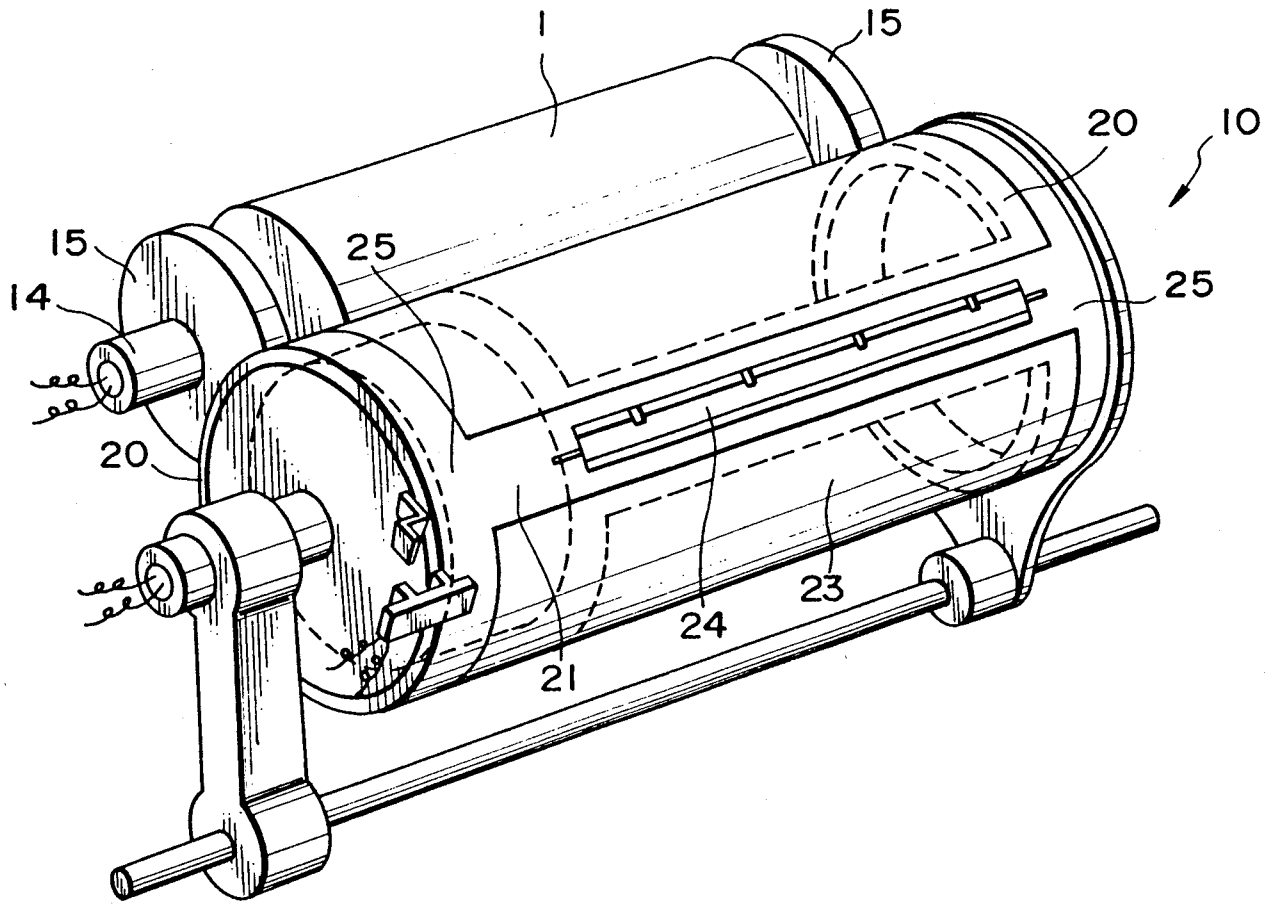
FIG. 9 is a perspective view of a photoconductive drum and a transfer drum included in a color copier of the present invention.

As shown in FIG. 9, the photoconductive drum 1 is mounted on a shaft 14. A positioning disk 15 is affixed to each end of the shaft 14. The transfer drum 10 has a framework made of up a pair of ring portions 20 and a connecting portion 21 connecting the ring portions 20. A film of polyethylene terephthalate 23 is wound around such a framework. The connecting portion 21 is provided with a paper clamper 24. A transfer charger, FIG. 8, is disposed in the transfer drum 10 and faces the photoconductive drum 1.

Figure 10:
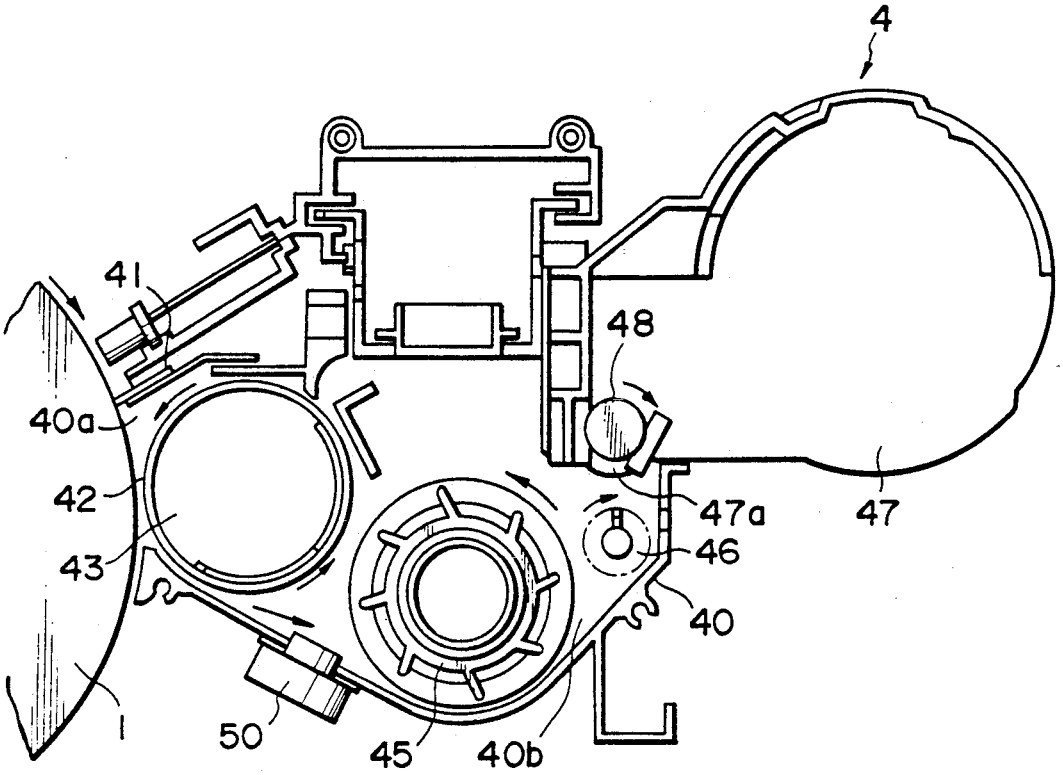
FIG. 10 is a section showing the construction of a developing device included in a color copier of the present invention.

The black developing unit 4 is shown in detail in FIG. 10. As shown, the black developing unit 4 has a casing 40 which is formed with an opening 40*a*, and an inlet seal 41 disposed above the opening 40*a*. A developer carrier in the form of a developing sleeve 42 is rotatable counterclockwise. The developing sleeve 42 is partly exposed through the opening 40*a* to face the photoconductive drum 1. A magnet roller 43 is accommodated in the developing sleeve 42. A paddle 45 and an agitator 46 are positioned in a developer storing portion 40*b* defined in the casing 40. The paddle 45 and the agitator 46 are rotatable counterclockwise and clockwise, respectively. A toner hopper 47 stores a toner therein and is provided with a toner supply opening 47*a*. A toner supply roller 48 is positioned in the toner supply opening 47*a* to stop the latter and is rotatable clockwise. As the toner supply roller 48 is rotated clockwise, it supplies the toner from the toner hopper 47 to the developer storing portion 40*b* via the toner supply opening 47*a*. A motor, not shown, is connected to the toner supply roller 48 via an electromagnetic clutch 62, FIG. 12, so as to start and stop the rotation of the roller 48. A toner concentration sensor 50 magnetically senses the concentration of the toner, which constitutes a two-component developer together with a magnetic carrier, existing in the developer storing portion 40*b*.

Figure 11:
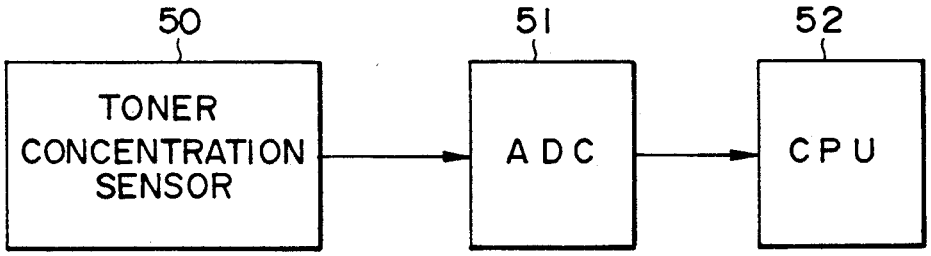
FIG. 11 is a block diagram schematically showing circuitry to which the output of a toner concentration sensor is applied.

As shown in FIG. 11, the toner concentration sensor 50 is connected to a CPU (Central Processing Unit) 52 incorporated in the copier via an analog-to-digital converter (ADC) 51.

Figure 12:
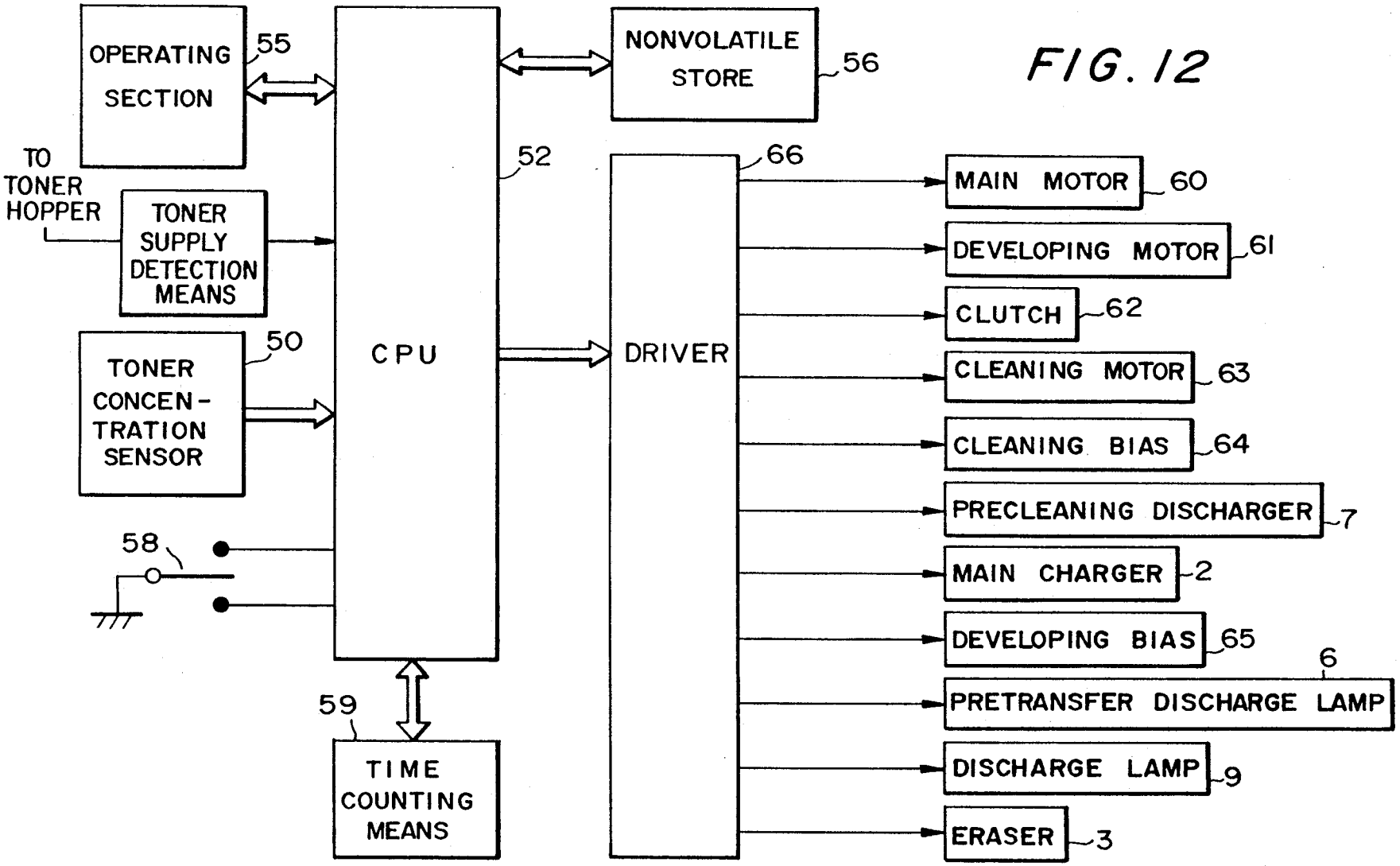
FIG. 12 is a block diagram schematically showing a control circuit incorporated in a color copier of the present invention.

As depicted in FIG. 12, connected to the CPU 52 are an operating section 55 including numeral keys and means for displaying the number of copies produced, nonvolatile store means implemented as a RAM (Random Access Memory) 56, toner supply detecting means for determining, when the toner hopper 47 runs out of toner, whether or not the toner hopper 47 has been supplied with a fresh toner, switching means 58 for selectively setting up an ordinary copy control mode or a toner concentration set control mode for controlling the toner concentration in the developer storing area 40*b*, and time counting means 59 for counting, for example, the duration of operation of the agitator 46 and paddle 45. A driver 66 connects to the CPU 52 a main motor 60 for driving the photoconductive drum 1, a developing motor 61 for driving the black developing unit 4 and color developing unit 5, the previously mentioned electromagnetic clutch 62, a cleaning motor 63 for driving the cleaning unit 8, a cleaning bias power source 64 for applying a bias voltage to a cleaning sleeve 8*a*, FIG. 8, included in the cleaning unit 8, the precleaning discharger 7, the main charger 2, a developing bias power source 65 for applying a bias voltage to each of the developing sleeve 4*a* of the black developing unit 4 and developing sleeves 5*a*, 5*b* and 5*c*, FIG. 8, included in the color developing unit 5, the pretransfer discharger 6, the discharge lamp 9, and the eraser 3.

The basic operation of the color copier for forming an image is as follows. As shown in FIG. 8, while the photoconductive drum 1 is rotated clockwise, the main charger 2 uniformly charges the surface of the drum 1. An image reading device, or scanner, 70 reads a document laid on a glass platen 71 by illuminating it. The resulting reflection from the document is incident to the drum 1 to electrostatically form a latent image on the charged surface of the drum 1. The eraser 3 dissipates the charge from the drum 1 outside of an image forming area. The developing sleeve 4*a* of the black developing unit 4 or any one of the developing sleeves 5a–5c of the color developing unit 5 feeds a corresponding toner to the latent image formed on the drum 1 to thereby convert it to a toner image. A paper sheet or similar recording medium is fed from a paper cassette 72 or 73 to the transfer drum 10 and clamped by the paper clamper 24, FIG. 9, to be retained on the drum 10. The transfer charger 30 transfers the toner image from the drum 1 to the paper sheet retained on the transfer drum 10. The paper sheet carrying the toner image thereon is separated from the transfer drum 10, transported to a fixing unit 75 to have the toner image fixed thereon, and then driven out of the copier. As the drum 1 is further rotated clockwise, a cleaning brush, not shown, mounted on the cleaning sleeve 8a removes the toner remaining on the drum 1. Subsequently, the discharge lamp 9 dissipates the charge also remaining on the drum 1. As a result, the drum 1 is ready to perform another image forming operation.

Figure 13:
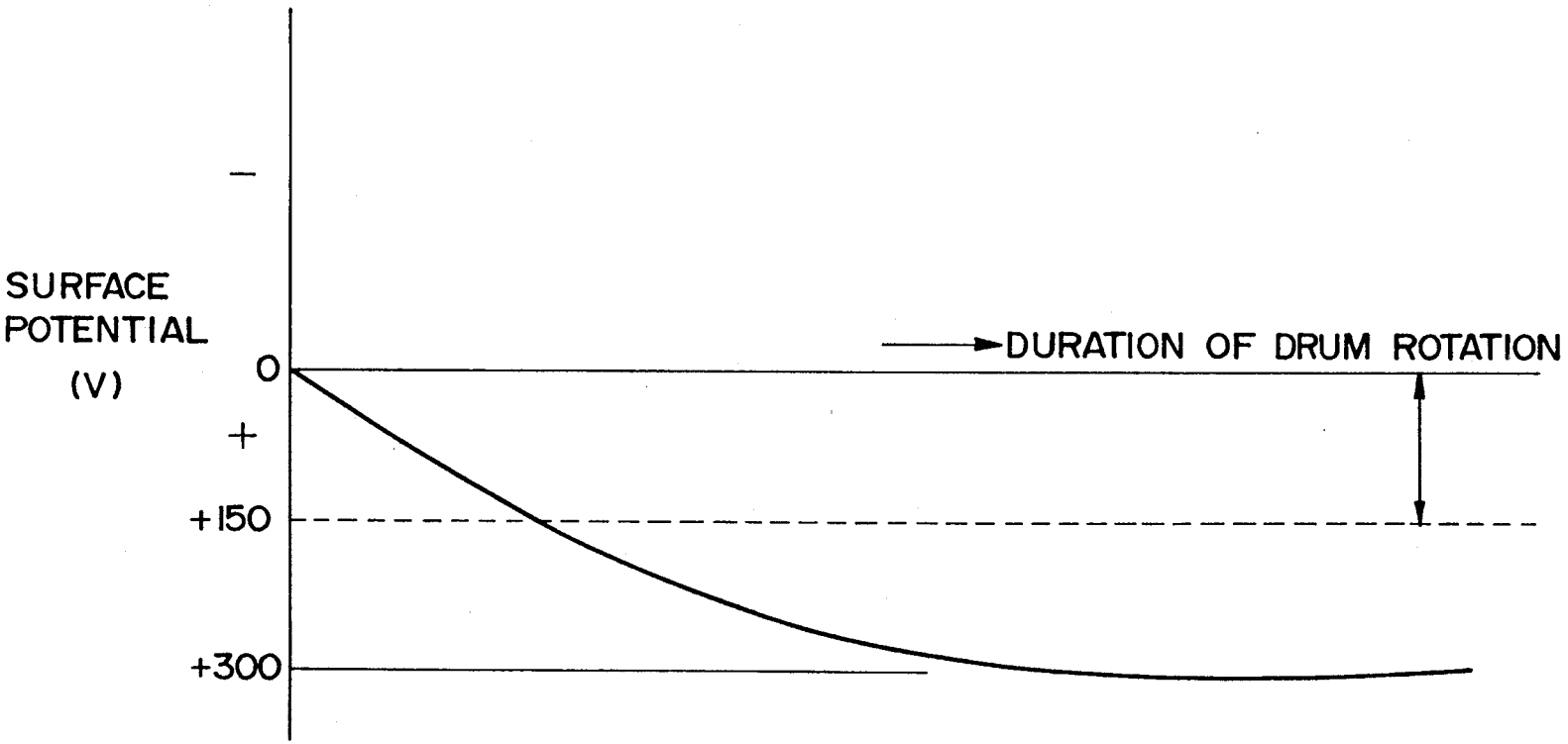
FIG. 13 is a graph indicative of a specific variation of the surface potential of a photoconductive drum.

A reference will be made to FIGS. 1, 2A and 2B for describing a copy control mode operation to be performed by the color copier, i.e., mainly by the CPU 52. When a copy start button included in the operating section 55 is pressed, the CPU 52 determines that a copying operation should be started (STEP 14, FIG. 1), starts on a copy control procedure, and then executes a subroutine CALL 100 shown in FIG. 2A (STEP 15). In the subroutine CALL 100, the CPU 52 energizes the main motor 60 for rotating the photoconductive drum 1, the eraser 3, the cleaning bias power source 64, the cleaning motor 63, and the developing bias power source 65 (STEP 101, FIG. 2A). Subsequently, the CPU 52 energizes the discharge lamp 9 and pretransfer discharger 6 (STEP 103), then energizes the precleaning charger 7 (STEP 104), and then energizes the main charger 2 (STEP 105). After such various units have each been brought to a stable state, the CPU 52 turns on the developing motor 61 (STEP 106). As a result, the photoconductive drum 1 is rotated. After the surface potential of the drum 1 has been raised from 0 V to +150 V which causes no toner to deposit on the drum 1, as shown in FIG. 13, and stabilized at such a voltage, the CPU 52 turns on the developing motor 61 to operate the developing unit 4 or 5. This prevents the developer from depositing on the drum 1.

Figure 1:
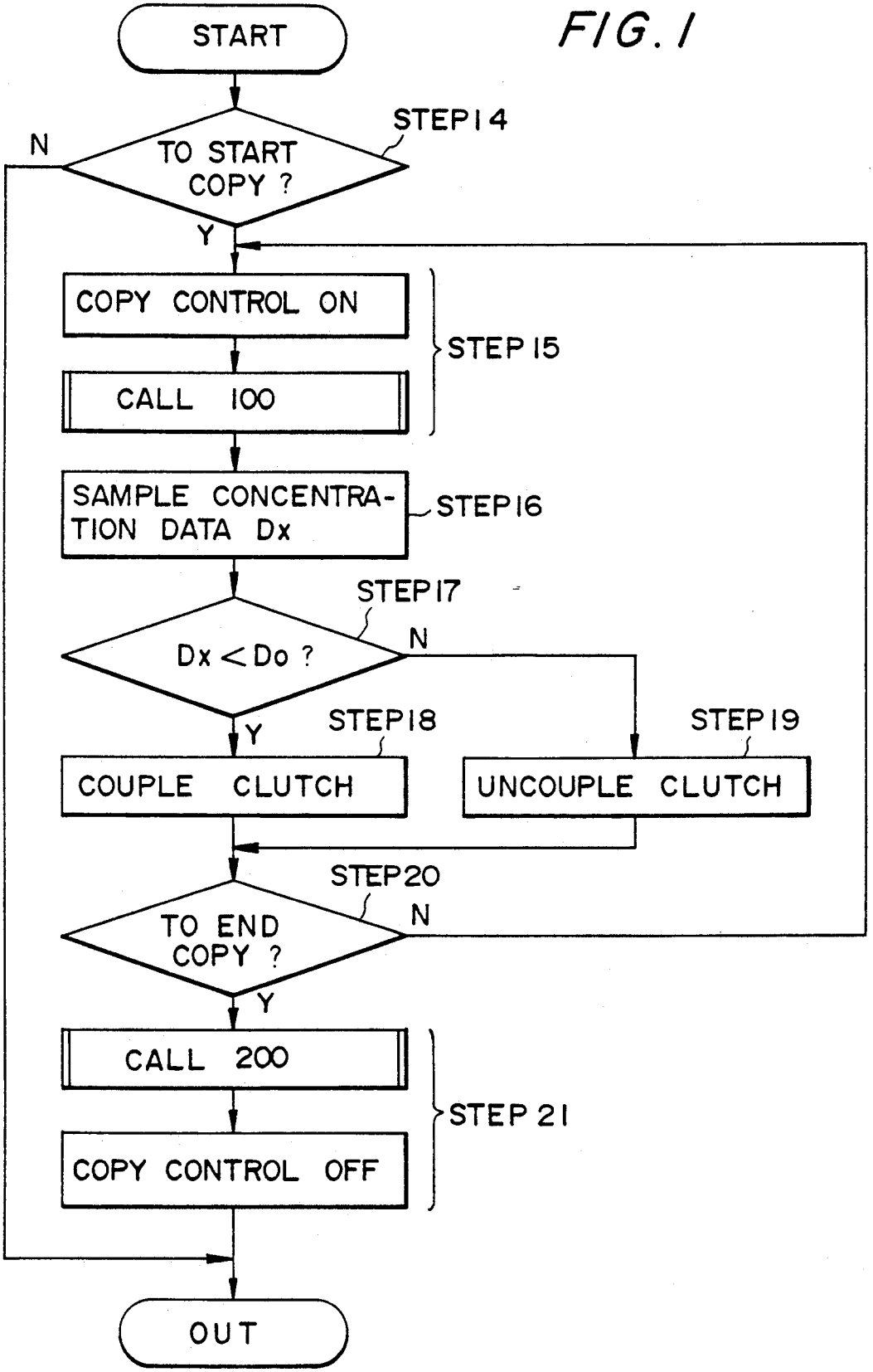
FIG. 1 is a flowchart representative of a copy control mode to be executed by a copier.
Figure 2A:
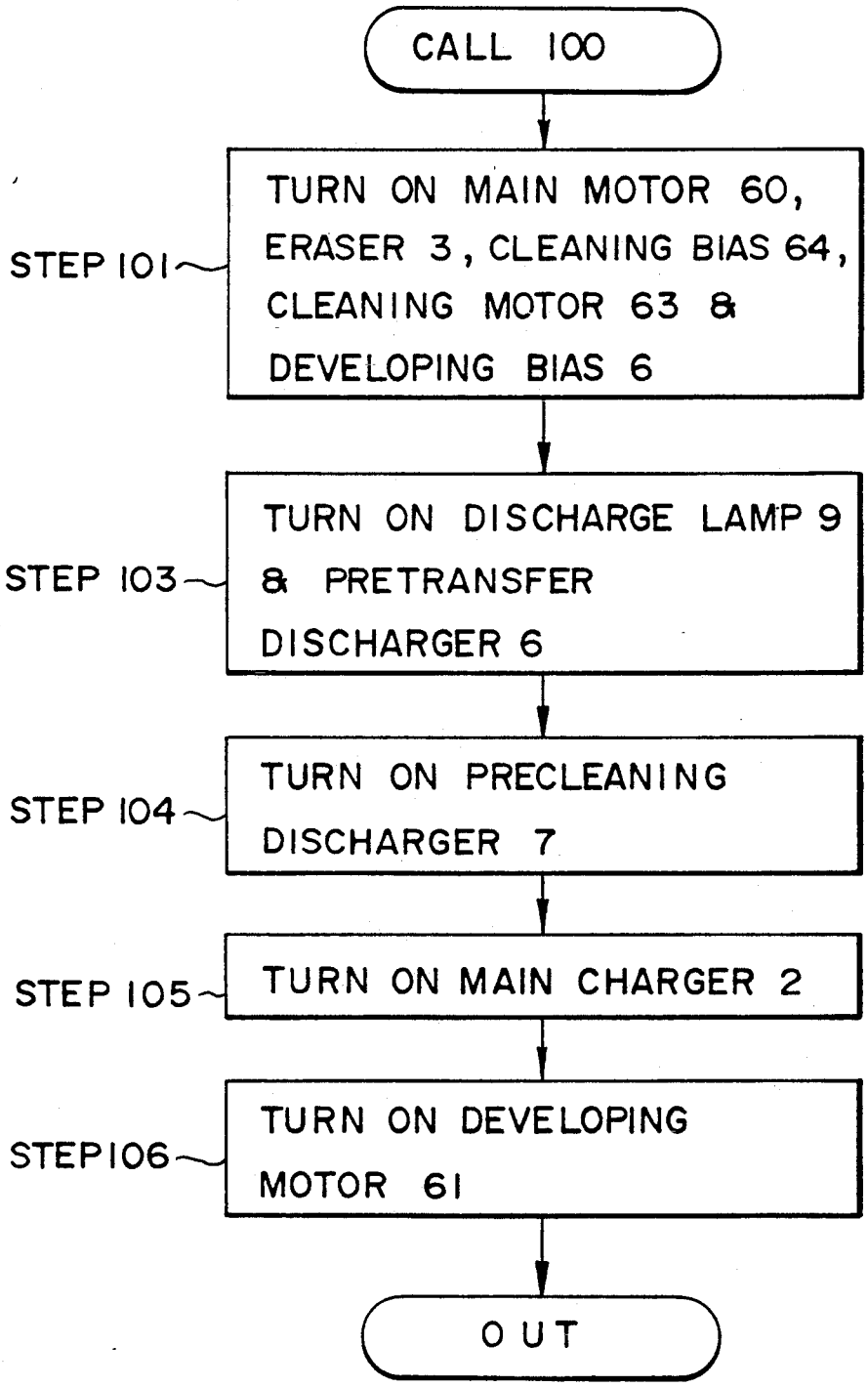
FIGS. 2A and 2B are flowcharts each showing a particular subroutine included in the copy control mode.
Figure 2B:
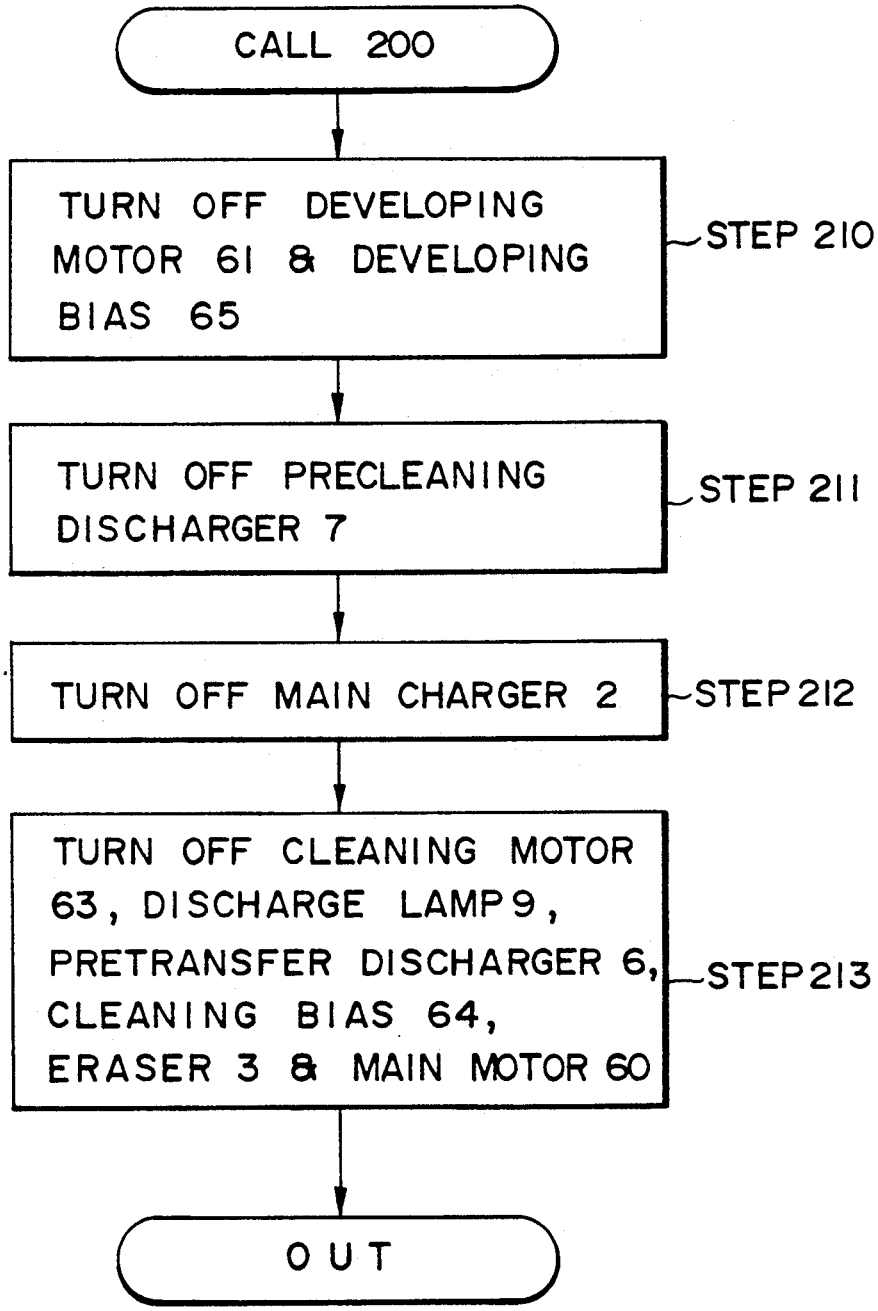

While a copying operation is under way, the toner concentration sensor 50 senses the concentration of the toner in the developing storing portion 40b while the sensed data Dx is sampled (STEP 16, FIG. 1). The CPU 52 compares the sampled data Dx with threshold data Do stored in the RAM 56 (STEP 17). If $Dx<Do$, the CPU 52 rotates the toner supply roller 48 to supply the toner from the toner hopper 47 to the developer storing portion 40b (STEP 18). If $Dx>Do$, the CPU 52 uncouples the clutch 62 to stop the rotation of the toner supply roller 48, whereby the toner supply is interrupted (STEP 19). Such a procedure is repeated to maintain the toner concentration in the developer storing portion 40b in a predetermined range.

Subsequently, the CPU 52 determines whether or not the copying operation has ended (STEP 20) and, if the answer is positive (Y), executes another subroutine CALL 200 shown in FIG. 2B and then completes the copy control mode (STEP 21). In the subroutine CALL 200, the CPU 52 deenergizes the developing motor 61 and developing bias power source 65 (STEP 210) and then the precleaning charger 7 (STEP 211). Thereafter, the CPU 52 turns off the main charger 2 (STEP 212) and then turns off the cleaning motor 63, discharge lamp 9, pretransfer discharger 6, cleaning bias power source 64, eraser 3, and main motor 60 (STEP 213).

Figure 3A:
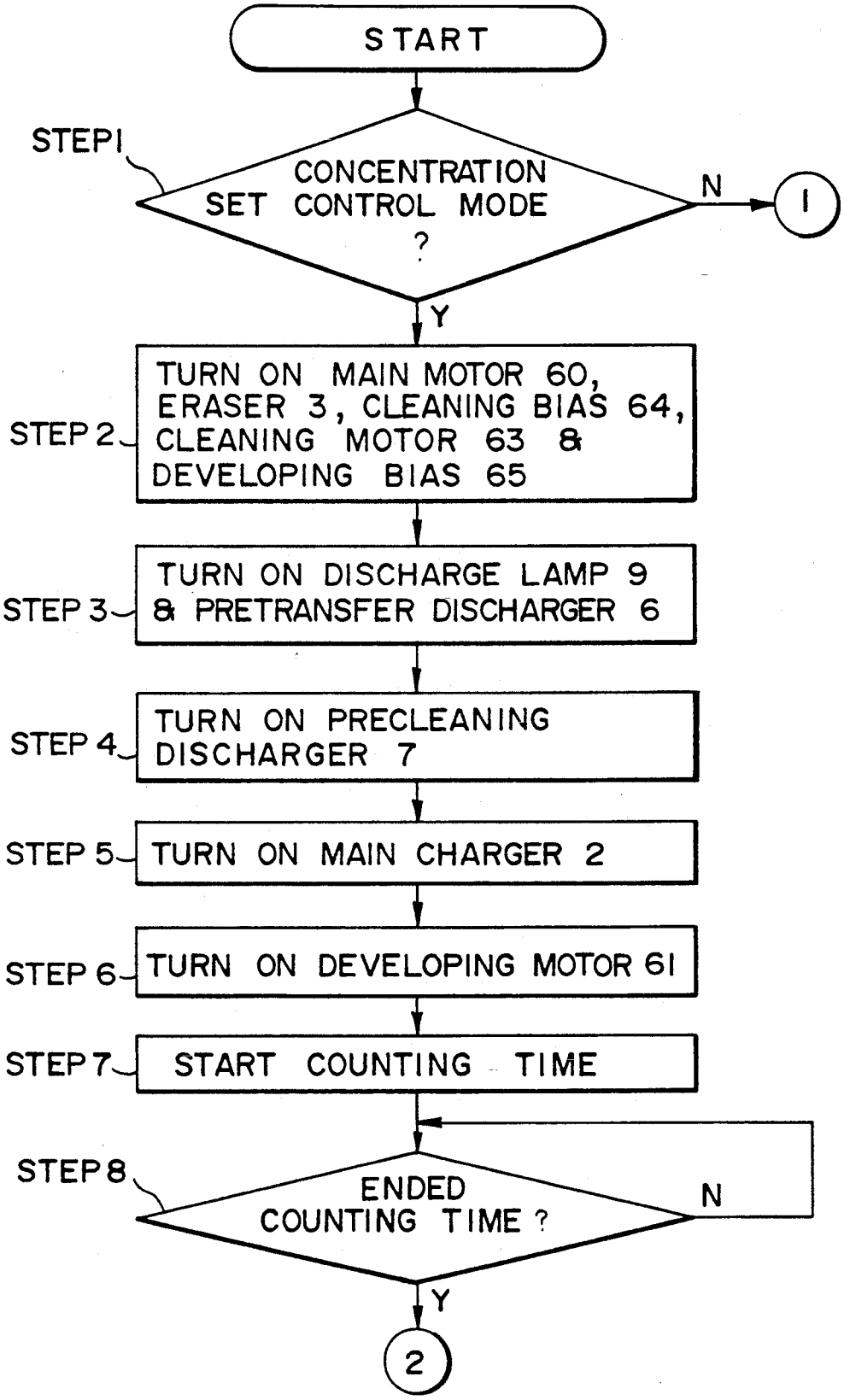
FIGS. 3A and 3B are flowcharts demonstrating a toner concentration set control mode available with the copier.
Figure 3B:
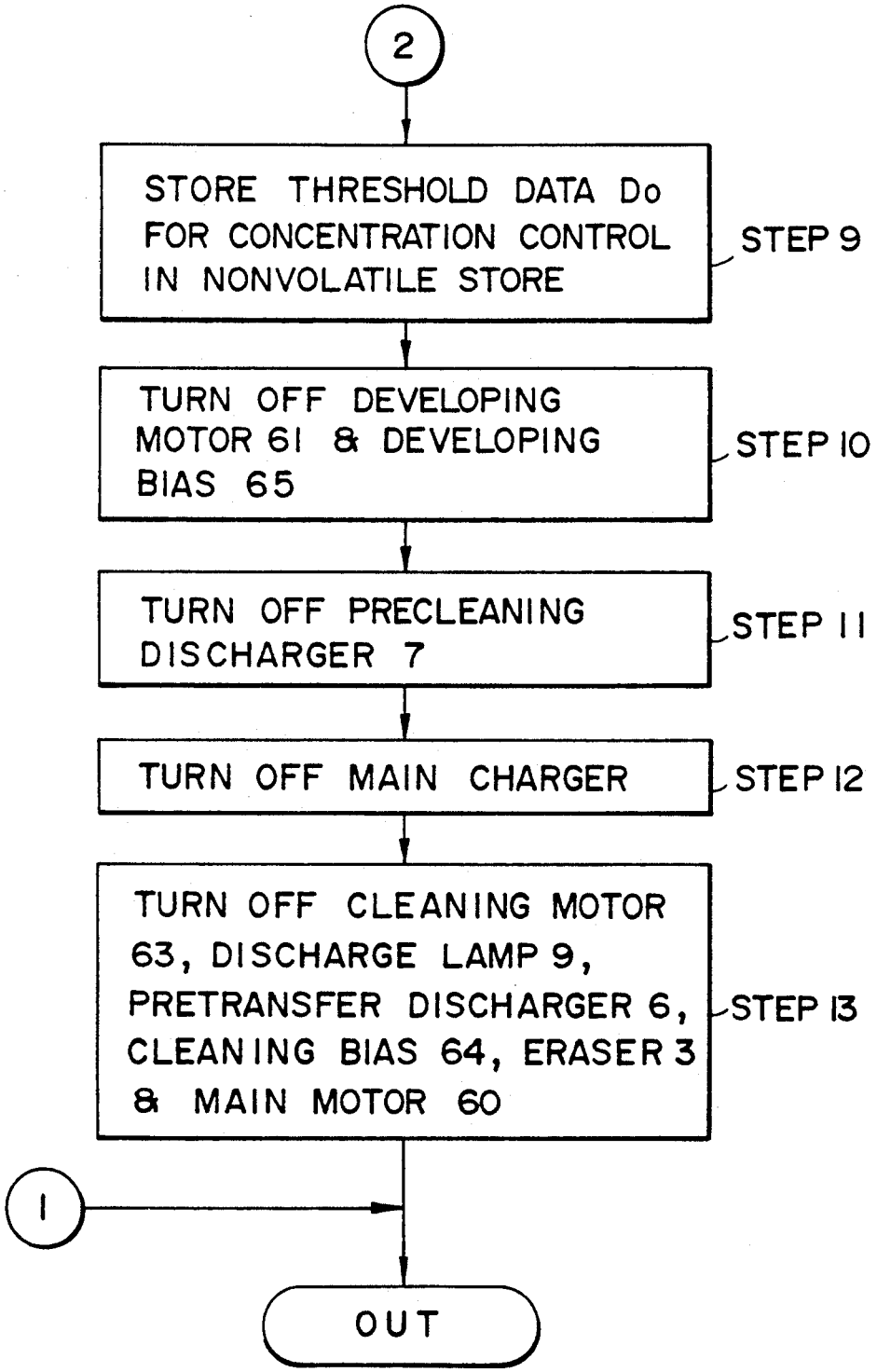
Figure 4:
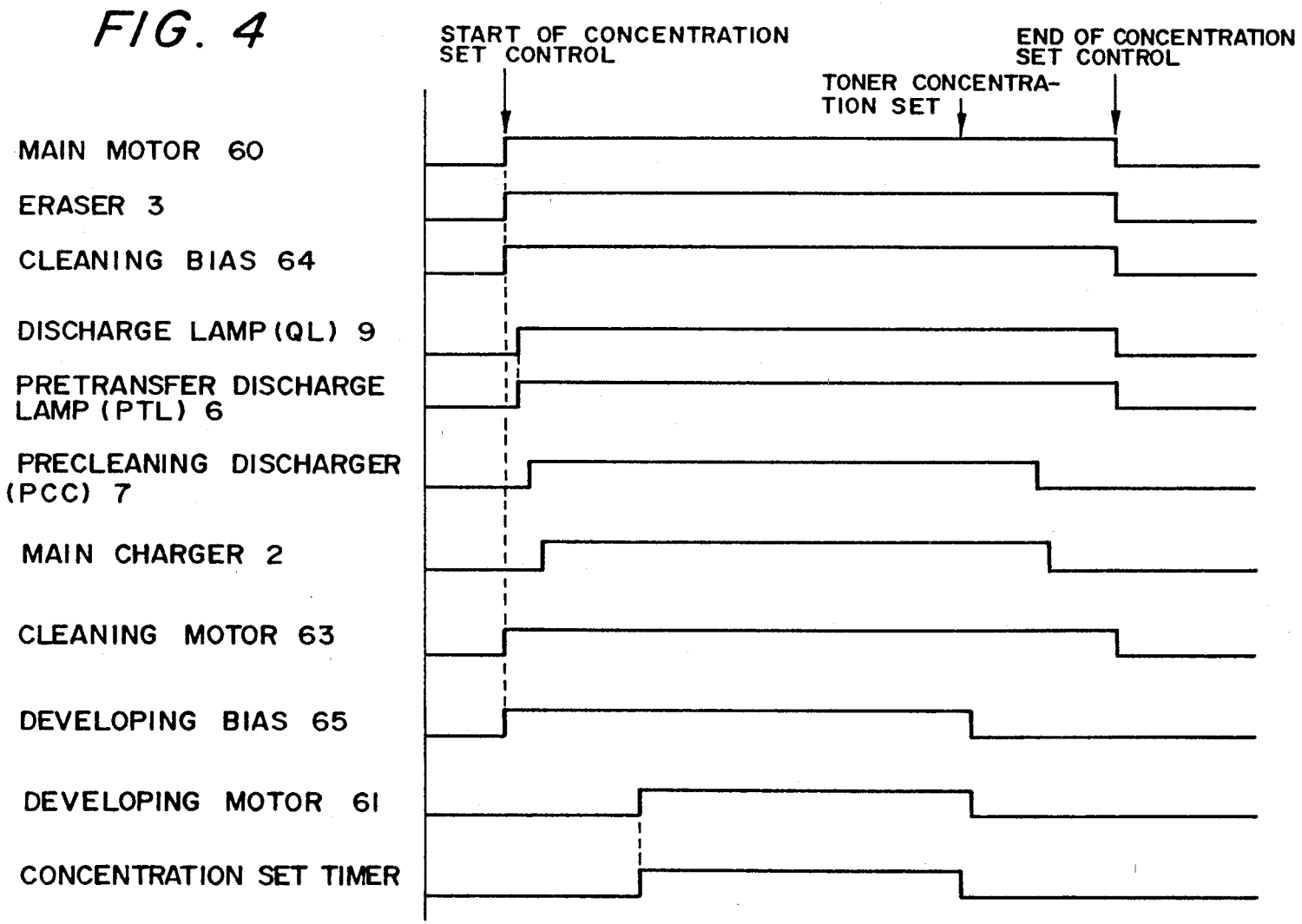
FIG. 4 is a timing chart representative of a toner concentration set control mode particular to a color copier of the present invention.

A toner concentration set control mode to be executed by the copier will be described with reference to FIGS. 3A and 3B. This mode is set up when switching means 58, FIG. 12, is operated. As the CPU 52 determines that such a control mode has been selected (STEP 1, FIG. 3A), it energizes the main motor 60, eraser 3, cleaning bias power source 64, cleaning motor 63, and developing bias power source 65 (STEP 2). Subsequently, the CPU 52 turns on the discharge lamp 9 and pretransfer discharger 6 (STEP 3), then the precleaning discharger 7 (STEP 4), and then the main charger 2 (STEP 5). After such units have each been brought to a stable state, the CPU 52 turns on the developing motor 61 to cause the paddle 45 and agitator 46 to agitate the developer in the developer storing portion 40b (STEP 6). Since the motor 61 is energized after the drum 1 has been rotated and increased in surface potential from 0 V to +150 V, as shown in FIG. 13, the developer on the developing sleeve 42 is prevented from depositing on the drum 1. As soon as the motor 61 is turned on to agitate the developer, the time counting means 59 starts counting the duration of the agitation (STEP 7). As the time counting means 59 counts a predetermined period of time (STEP 8), the toner concentration sensor 50 senses the toner concentration of the developer. The sensed toner concentration is written to the RAM 56 as threshold data Do for toner concentration control (STEP 9, FIG. 3B).

Thereafter, the CPU 52 turns off the developing bias power source 65 (STEP 10), and then the precleaning discharger 7 (STEP 11). Further, the CPU 52 turns off the main charger 2 (STEP 12) and then the cleaning motor 63, discharge lamp 9, pretransfer discharger 6, cleaning bias power source 64, eraser 3, and main motor (STEP 13). After the toner concentration set control mode, the switching means 58 is operated to restore the copier to the ordinary copy control mode.

While the switching means 58 is shown as being implemented as a switch independent of the operating section, it may be implemented by a special key (not used during ordinary copying) included in the operating section and becoming valid when pressed twice, a code number entered on numeral keys, or a combination of the special key and the code number.

Figure 5A:
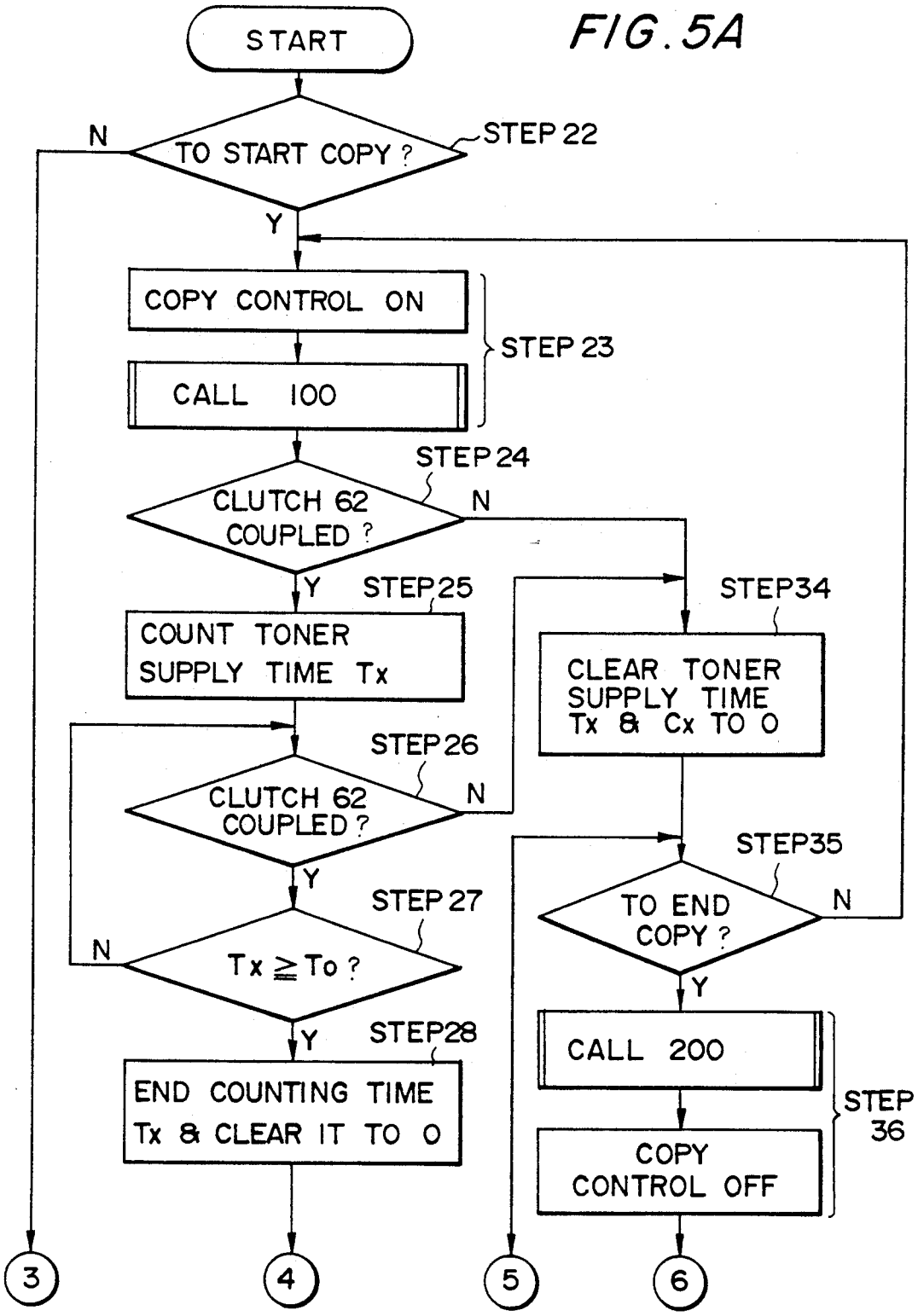
FIGS. 5A and 5B are flowcharts representative of a toner end control mode to be executed by a color copier of the present invention.
Figure 5B:
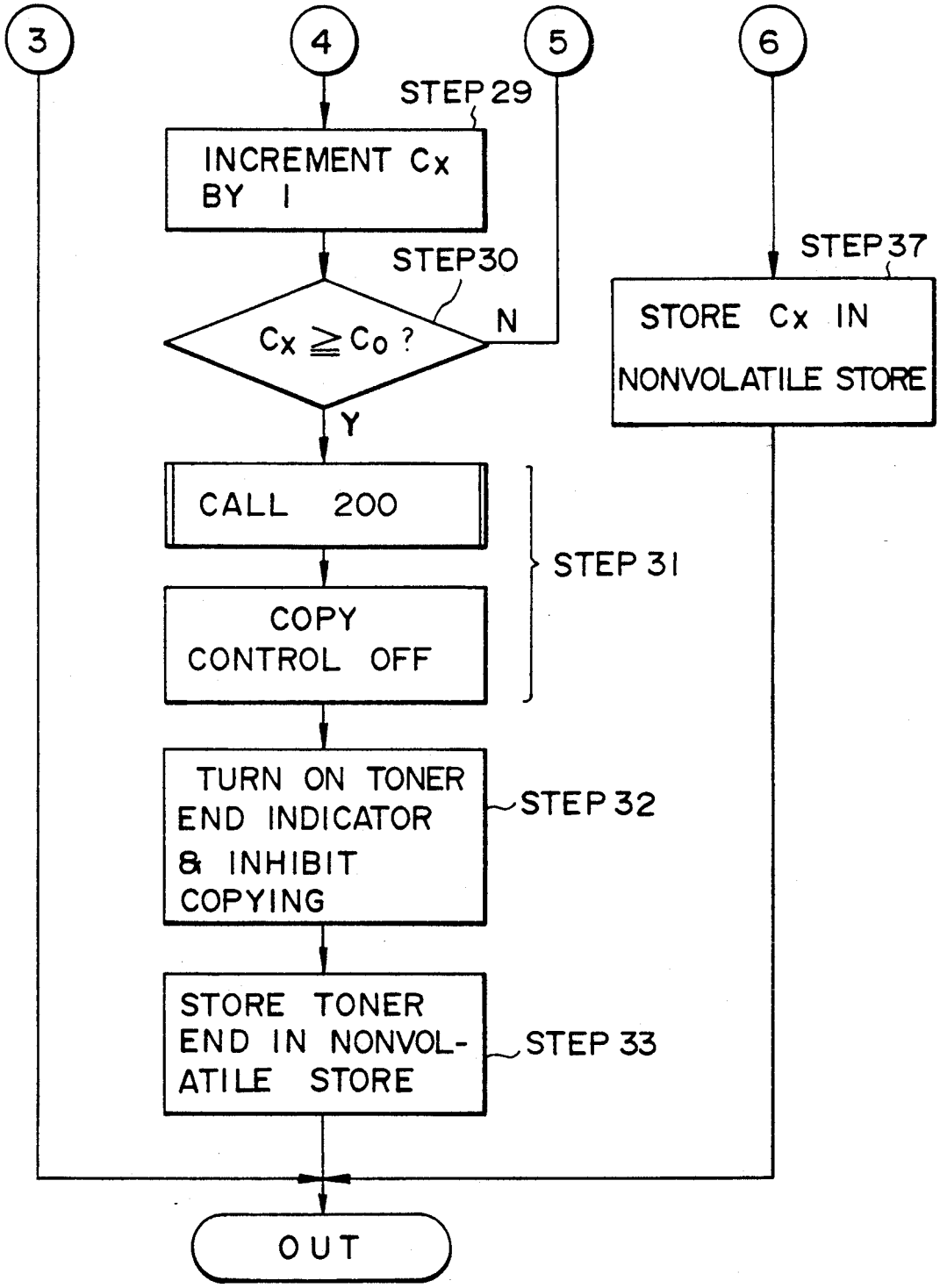
Figure 6A:
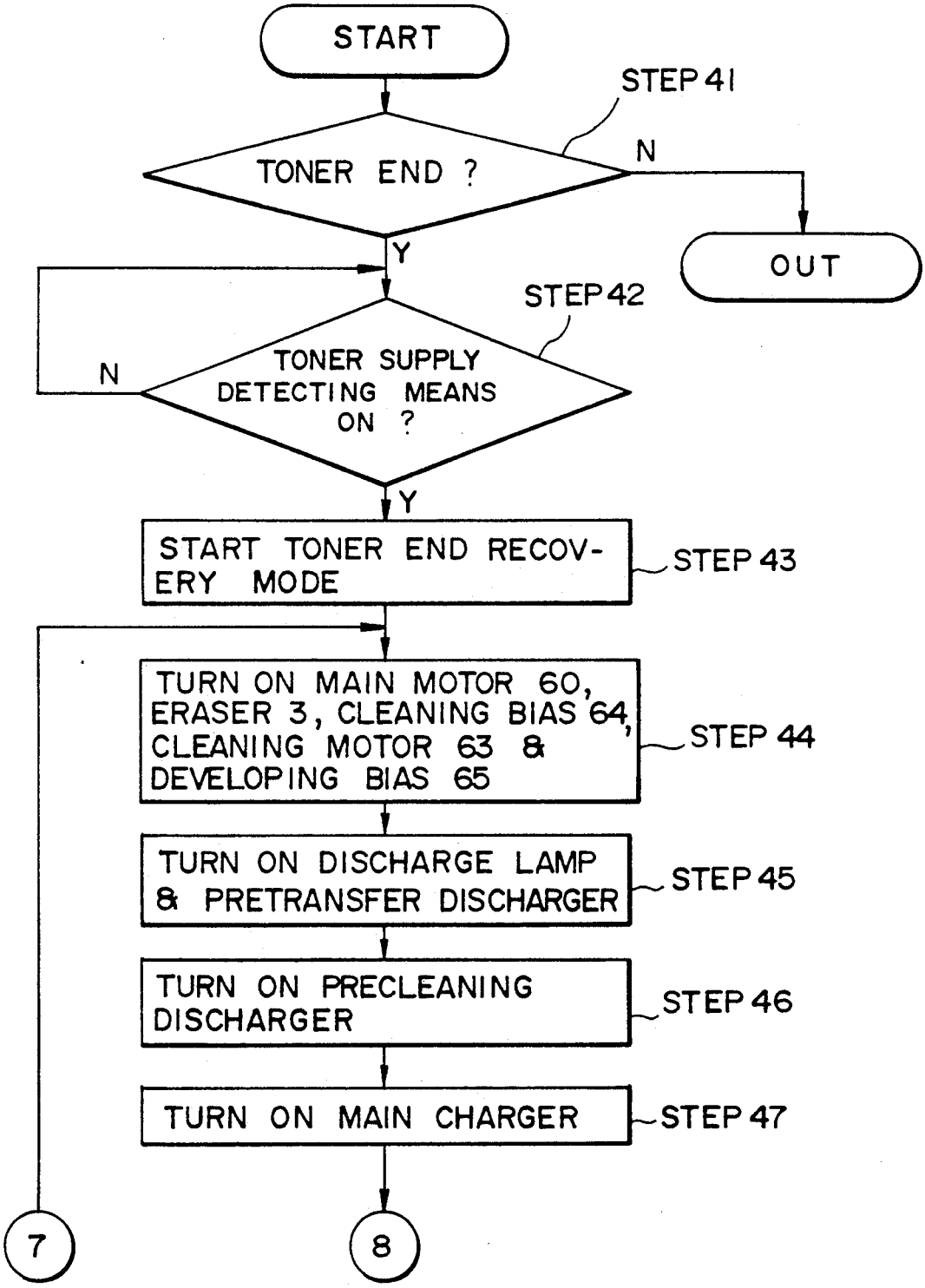
FIGS. 6A–6D are flowcharts showing a toner end recovery mode available with a color copier of the present invention.
Figure 6B:
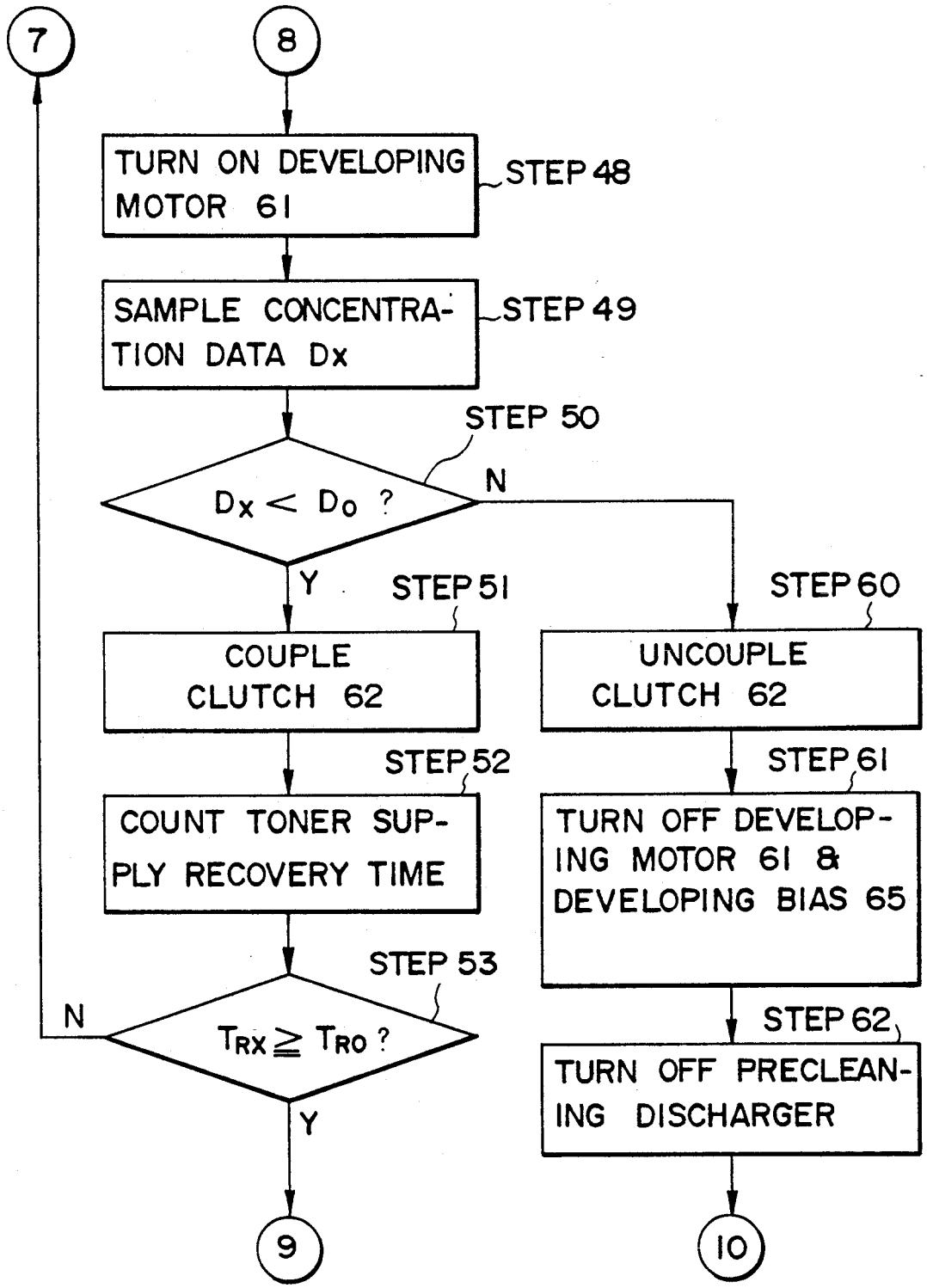
Figure 6C:
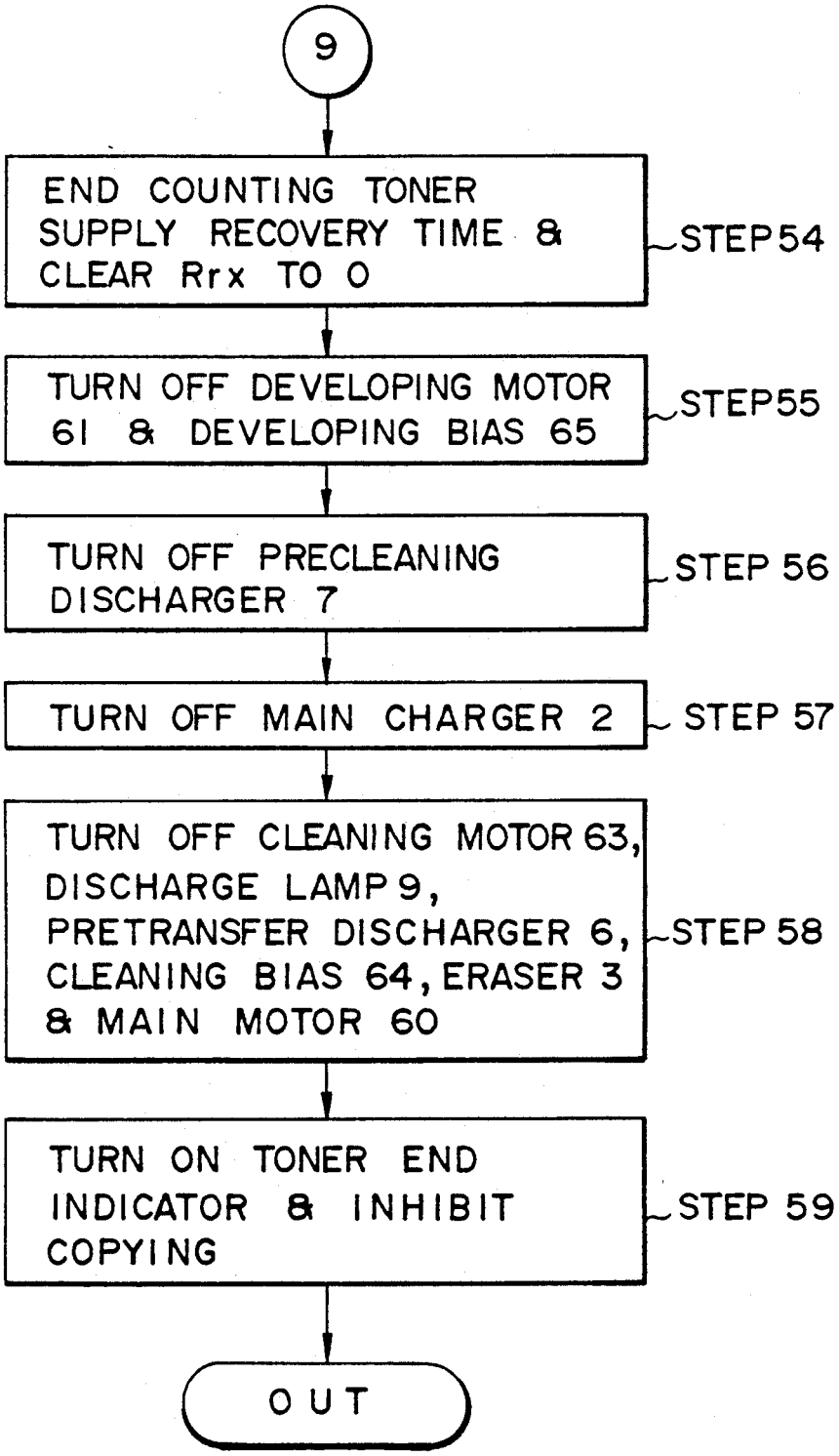
Figure 6D:
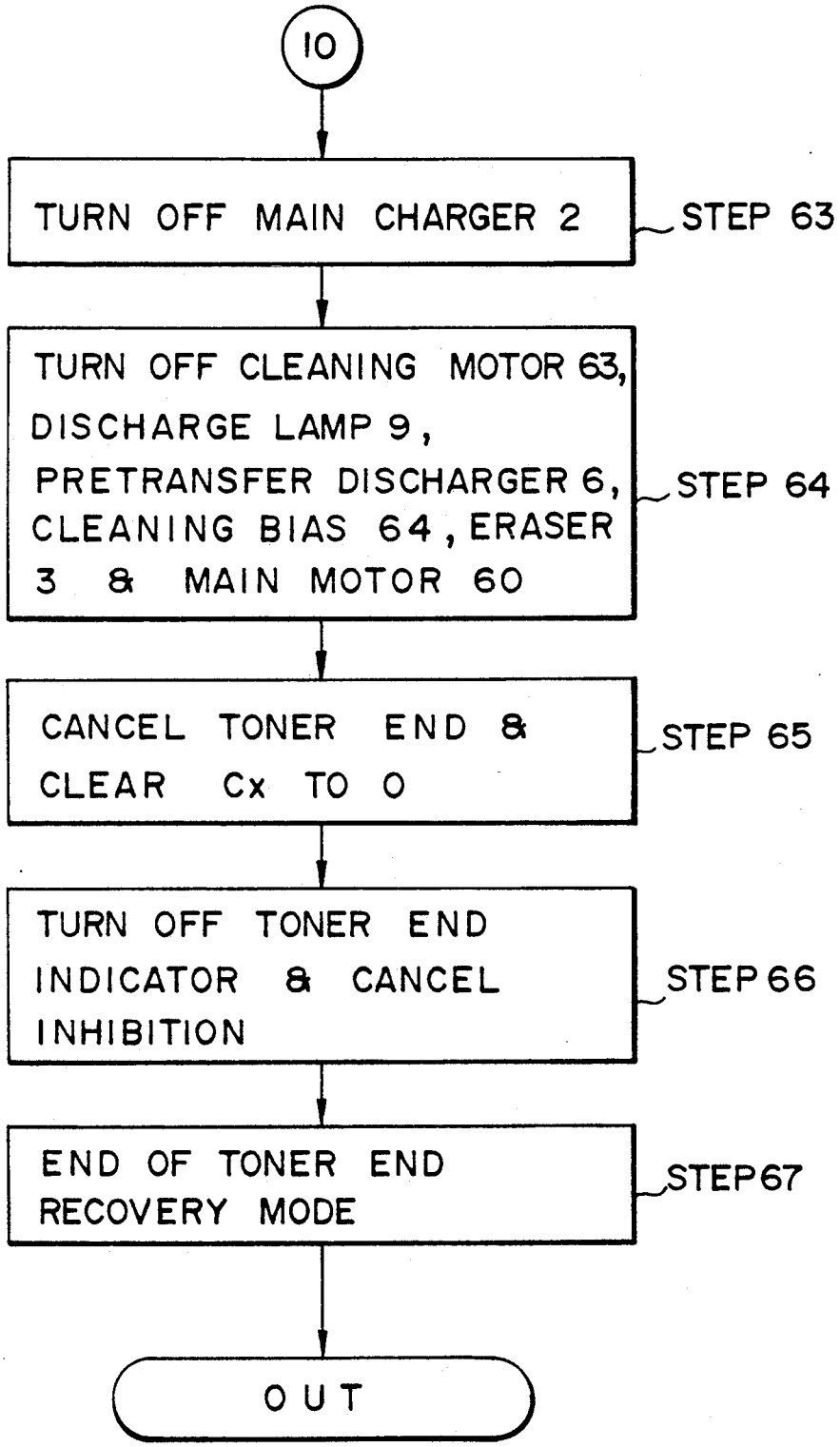
Figure 7:
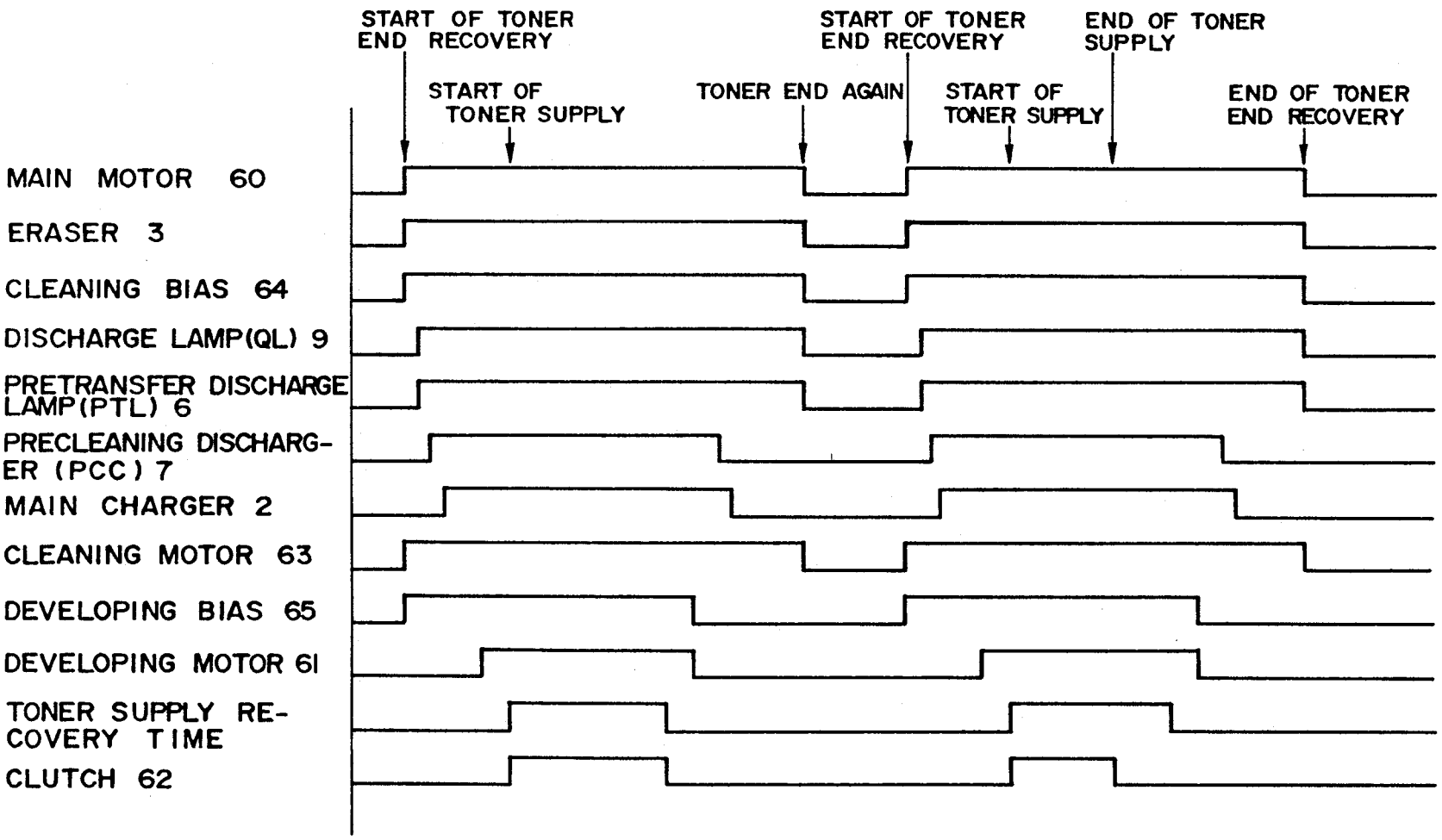
FIG. 7 is a timing chart representative of a toner end recovery mode particular to a color copier of the present invention.

Referring to FIGS. 5A and 5B, a toner end mode to be also executed by the copier is shown. As the copy start button of the operating section 55 is pressed, a copying operation starts (STEP 22, FIG. 5A) and the various units are activated. In this condition, the CPU 52 starts on the copy control mode and executes the subroutine CALL 100, FIG. 2A, (STEP 23). So long as the clutch 62 is continuously coupled while the copying operation is under way (STEP 24), the period of time Tx over which the toner supply roller 48 is rotated to supply the toner from the toner hopper 47 is counted (STEP 25). When the toner hopper 47 runs out of toner, the clutch 62 is continuously coupled (STEP 26). Hence, a period of time To necessary for the clutch 62 to operate to produce a single copy is set beforehand. When the clutch 62 is continuously coupled for more than the reference period of time To (STEP 27), the CPU 52 stops counting the time Tx and clears it to zero by determining that the toner hopper 47 has run out of toner (STEP 28).

Subsequently, the CPU 52 increments a toner end counter Cx by 1 (one) (STEP 29, FIG. 5B) and then compares the toner counter Cx with a predetermined toner end set counter Co (STEP 30). As Cx exceeds Co, the CPU 52 executes the subroutine CALL 200 and stops the units other than the units having been already stopped in CALL 200, thereby interrupting the copying operation under way (STEP 31). At the same time, the CPU 52 turns on a toner end indicator and inhibits the copier from being operated (STEP 32). Thereafter, the CPU 52 stores the toner end condition in the RAM 56 (STEP 33).

When the clutch 62 is uncoupled in the copy control mode (STEP 24 or 26, FIG. 5A), the CPU 52 stops counting the toner supply time Tx, clears the period of time Tx to zero as well as the toner end counter Cx (STEP 34). If the toner end counter Cx is short of the toner end set counter Co (STEP 30, FIG. 5B), the CPU 52 continues the copy control mode. However, if the copying operation should be interrupted (STEP 35), the CPU 52 stops the copying operation by way of the subroutine CALL 200 (STEP 36). After the stop of the copying operation, the CPU 52 stores the existing content of the toner end counter Cx in the RAM 56 (STEP 37, FIG. 5B) and will cause the toner end counter Cx to start counting again in the next copying operation.

A toner end recovery mode will be described with reference to FIGS. 6A-6D and 7. The CPU 52 checks the output of a toner end sensor, not shown, to see if the toner hopper 47 has run out of toner (STEP 41, FIG. 6A). Then, the toner hopper 47 is refilled with a fresh toner. The fresh toner may be fed from a toner cartridge removably mounted on the toner hopper 47 or may be directly fed into the toner hopper 47. Toner supply detecting means 57 is responsive to the supply of a fresh toner to the toner hopper 47. Specifically, the toner supply detecting means 57 determines whether or not a fresh toner has been fed to the toner hopper 47 by detecting that a used toner cartridge has been removed, that a new toner cartridge has been set, or that a lid associated with the toner hopper 47 has been opened or closed by way of example (STEP 42). As the toner supply detecting means 57 detects the supply of a fresh toner to the toner hopper 47, the CPU 52 starts on a toner end recovery mode (STEP 43). Then, the CPU 52 turns on the main motor 60, eraser 3, cleaning bias power source 64, cleaning motor 63, and developing bias power source 65 (STEP 44). Thereafter, the CPU 52 turns on the discharge lamp 9 and pretransfer discharger 6 (STEP 45), then the precleaning discharger 7 (STEP 46), and then the main charger 2 (STEP 47).

As soon as the units turned on as stated above have been stabilized, the CPU 52 energizes the developing motor 61. As a result, the developing sleeve 42 is driven, and the paddle 45 and agitator 46 agitate the developer in the developer storing portion 40*b* (STEP 48, FIG. 6B). At this instant, the developer on the developing sleeve 42 is prevented from depositing on the drum 1 since the motor 61 is energized after the drum 1 has been rotated and the surface potential of the drum 1 has been raised from 0 V to +150 V and stabilized at such a voltage. When the agitation of the developer by the paddle 45 and agitator 46 is stabilized, the CPU 52 samples toner concentration data Dx (STEP 49) and compares it with the threshold data Do previously written to the RAM 56 (STEP 50). If $Dx<Do$, the CPU 52 couples the clutch 62 to thereby rotate the toner supply roller 48 (STEP 51). As a result, the toner stored in the toner hopper 47 is supplied to the developer storing portion 40*b*. As the toner supply begins, the time counting means 59 starts counting the duration of toner supply, i.e., toner supply recovery time Trx (STEP 52). The CPU 52 compares the toner supply recovery time Trx with a reference toner recovery time Tro (STEP 53) and, if the clutch 62 remains coupled even after Trx has exceeded Tro, ends counting the time Trx and clears it to zero (STEP 54, FIG. 6C).

Subsequently, the CPU 52 turns off the developing bias power source 65 (STEP 55), then the precleaning discharger 7 (STEP 56), and then the main charger 2 (STEP 57). Further, the CPU 52 deenergizes the cleaning motor 63, discharge lamp 9, pretransfer discharger 6, cleaning bias power source 64, eraser 3, and main motor 60 to thereby end the toner end recovery mode (STEP 58). Assume that the actual toner concentration data Dx does not reach the reference or threshold data Do for toner concentration control even after the toner supply recover time Trx has exceeded the reference time Tro. Then, the CPU 52 determines that the toner concentration is not sufficient for development, turns on the toner end indicator of the operating section 55, and continuously holds the copier in the inhibited state. This part of the procedure is to cope with an occurrence that the operator accidentally sets an empty cartridge on the toner hopper 47 or forgets to supply a fresh toner to the toner hopper 47.

When the actual toner concentration data Dx has exceeded the threshold data Do (STEP 50, FIG. 6B), the CPU 52 uncouples the clutch 62, ends counting the toner recovery time Trx, and clears it to zero (STEP 60). Just after the clutch 62 has been uncoupled, the supplied toner has not been sufficiently mixed with the developer yet. Hence, it is necessary to agitate the developer sufficiently by the agitator 46 and paddle 45 to thereby stabilize the amount of charge deposited thereon. It follows that the developing bias power source 64 and developing motor 61 have to be continuously energized until the amount of charge on the developer has been stabilized. Subsequently, the CPU 52 deenergizes the motor 61 and bias power source 65 to stop agitating the developer (STEP 61), then turns off the precleaning charger 7 (STEP 62), and then turns off the main charger 2 (STEP 63, FIG. 6D). Further, the CPU 52 deenergizes the cleaning motor 63, discharge lamp 9, pretransfer discharger 6, cleaning bias power source 64, eraser 3, and main motor 60 to end the toner end recovery procedure (STEP 64). Finally, the CPU 52 clears the toner end counter Cx stored in the RAM 56 to zero (STEP 65), turns off the toner end indicator and an inhibition indicator (STEP 66), and then completes the toner end recovery mode (STEP 67).

In summary, in accordance with the present invention, even when a developing unit is operated while an image forming operation is not under way, a toner and a carrier forming a magnet brush on a developing roller included in the developing unit are prevented from depositing on a photoconductive element and, therefore, from being scattered around, damaging the photoconductive element or contaminating the background. Further, the carrier is prevented from causing a spark to occur in a corona discharger and burning the discharger by entering it.

Various modifications will become possible for those skilled in the art after receiving the teachings of the present disclosure without departing from the scope thereof.

What is claimed is:

1. An image forming apparatus comprising:

an image carrier for electrostatically forming a latent image thereon;

charging means for uniformly charging a surface of said image carrier;

exposing means for exposing the charged surface of said image carrier by imagewise light to form the latent image;

developing means comprising a developer carrier located to face said image carrier and carrying a two-component developer made up of a toner and a carrier thereon for developing the latent image by supplying said toner to said latent image;

toner concentration adjusting means for performing a toner concentration adjusting operation including drive of said developer carrier for controlling a toner concentration of said developer to a predetermined value;

cleaning means for removing the toner remaining on said image carrier after a developing operation;

discharging means for dissipating a charge from said image carrier; and control means for activating at least said image carrier, said cleaning means and said discharging means in synchronism with the toner concentration adjusting operation of said toner concentration adjusting means, such that after an interrupt state occurring during a normal copy operation, said control means activates said developing means after said image carrier has been charged to a predetermined potential by said charging means, said cleaning means has removed any remaining toner from the image carrier, and the discharging means has dissipated any remaining charge from the image carrier.

2. An apparatus as claimed in claim 1, wherein said control means causes, when activating said image carrier, said cleaning means, and said discharging means, said discharging means to operate after said image carrier and said cleaning means have operated to remove the toner from the entire latent image.

3. An image forming apparatus comprising:

an image carrier for electrostatically forming a latent image thereon;

charging means for uniformly charging a surface of said image carrier;

exposing means for exposing the charged surface of said image carrier by imagewise light to form the latent image;

developing means comprising a developer carrier located to face said image carrier and carrying a two-component developer made up of a toner and a carrier thereon for developing the latent image by supplying said toner to said latent image;

a toner storing portion for storing a toner to be supplied to the developer carrier;

toner end recovery means for performing, after the toner in said toner storing portion has decreased to below a predetermined amount and then a fresh toner has been supplied to said toner storing portion, a toner end recovery operation including drive of said image carrier for allowing said developing means to perform an adequate developing operation;

cleaning means for removing the toner remaining on said image carrier after a developing operation;

discharging means for dissipating a charge from said image carrier; and control means for activating at least said image carrier, said cleaning means and said discharging means in synchronism with the toner end recovery operation of said toner end recovery means, such that after an interrupt state occurring during a normal copy operation, said control means activates said developing means after said image carrier has been charged to a predetermined potential by said charging means, said cleaning means has removed any remaining toner from the image carrier, and the discharging means has dissipated any remaining charge from the image carrier.

4. An apparatus as claimed in claim 3, wherein said control means causes, when activating said image carrier, said cleaning means, and said discharging means, said discharging means to operate after said image carrier and said cleaning means have operated to remove the toner from the entire latent image.

5. The image forming apparatus according to claim 3, wherein after said discharging means has dissipated the remaining charge from said image carrier, a toner supply means supplies toner to the developer carrier.

6. An image forming apparatus comprising:

an image carrier for electrostatically forming a latent image thereon;

charging means for uniformly charging a surface of said image carrier;

exposing means for exposing the charged surface of said image carrier by imagewise light to form the latent image;

developing means comprising a developer carrier located to face said image carrier and carrying a two-component developer made up of a toner and a carrier thereon for developing the latent image by supplying said toner to said latent image;

toner concentration adjusting means for performing a toner concentration adjusting operation including drive of said developer carrier for controlling a toner concentration of said developer to a predetermined value;

cleaning means for removing toner remaining on said image carrier after a developing operation;

discharging means for dissipating a charge from said image carrier; and control means for activating at least said image carrier, said cleaning means and said discharging means in synchronism with the toner concentration adjusting operation of said toner concentration adjusting means, such that after said image carrier has been charged by the charging means, cleaned by said cleaning means and then discharged by said discharging means, the developing means is activated and, thereafter, threshold data is used for controlling said toner concentration adjusting means, thereby performing a density control operation.

* * * * *